US009725266B2

(12) United States Patent
Anzai

(10) Patent No.: US 9,725,266 B2
(45) Date of Patent: Aug. 8, 2017

(54) RECORDING APPARATUS AND METHOD FOR MOVING MEDIUM SUPPORT UNIT

(71) Applicant: SEIKO EPSON CORPORATION, Tokyo (JP)

(72) Inventor: Sumito Anzai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/054,374

(22) Filed: Feb. 26, 2016

(65) Prior Publication Data

US 2016/0272445 A1 Sep. 22, 2016

(30) Foreign Application Priority Data

Mar. 20, 2015 (JP) ..... 2015-057889

(51) Int. Cl.

| | |
|---|---|
| ***B41J 3/407*** | (2006.01) |
| ***B41J 11/06*** | (2006.01) |
| ***B41J 13/16*** | (2006.01) |
| ***B65H 5/04*** | (2006.01) |
| ***B65H 7/02*** | (2006.01) |

(52) U.S. Cl.

CPC ..... *B65H 5/04* (2013.01); *B41J 3/4078* (2013.01); *B41J 11/06* (2013.01); *B41J 13/16* (2013.01); *B65H 7/02* (2013.01)

(58) Field of Classification Search

CPC ..... B41J 3/4078; B41J 11/06; B41J 13/16; B65H 5/04

See application file for complete search history.

(56) References Cited

U.S. PATENT DOCUMENTS

| | | | | |
|---|---|---|---|---|
| 4,177,591 | A | 12/1979 | Thompson et al. | |
| 2005/0024462 | A1 | 2/2005 | Yoshikaie | |
| 2007/0076081 | A1* | 4/2007 | Yoshida | B41J 11/0065 347/104 |
| 2012/0321366 | A1* | 12/2012 | McLaughlin | B41J 11/42 400/583 |

FOREIGN PATENT DOCUMENTS

| | | |
|---|---|---|
| EP | 0 151 425 | 8/1985 |
| JP | 2005-007691 A | 1/2005 |
| JP | 2014-024233 | 2/2014 |
| JP | 2014-024233 A | 2/2014 |

OTHER PUBLICATIONS

European Search Report for Application No. 16158801.7 dated Jul. 25, 2016.

* cited by examiner

*Primary Examiner* — Jason Uhlenhake
(74) *Attorney, Agent, or Firm* — Workman Nydegger

(57) ABSTRACT

A recording apparatus includes a medium support unit that is capable of moving by driving of a motor in a moving direction and is capable of supporting a medium, a recording unit that records an image onto the medium supported on the medium support unit, and a control unit that allows the motor to execute an assist operation for assisting the movement of the medium support unit when recognizing the movement of the medium support unit without depending on the driving of the motor.

9 Claims, 9 Drawing Sheets

RECORDING APPARATUS AND METHOD FOR MOVING MEDIUM SUPPORT UNIT

BACKGROUND

1. Technical Field

The present invention relates to a recording apparatus and a method for moving a medium support unit.

2. Related Art

In the related art, various recording apparatuses have been used. Among such recording apparatuses, a recording apparatus including a medium support unit that is moved by driving of a motor is often used.

Furthermore, a recording apparatus which allows a user to move a configuration member, which is moved by driving of the motor, without depending on the driving of the motor, is used. In such a recording apparatus, when moving the configuration member without depending on the driving of the motor, in order to suppress a load of the user, a device capable of assisting the movement of the configuration member is disclosed.

For example, a recording apparatus in which an assist force is imparted by an ejection driving roller when manually feeding a disc tray in the recording apparatus and movement of the disc tray can be assisted when manually feeding the disc tray in the recording apparatus is disclosed in JP-A-2014-24233.

In a recording apparatus including a medium support unit that is moved by driving a motor, there is a case in which the medium support unit is moved by the user without depending on the driving of the motor (for example, manually). However, a strong force is required and a load is often imposed on the user to move such a medium support unit without depending on the driving of the motor.

Here, in the recording apparatus disclosed in JP-A-2014-24233, it is possible to suppress the load of the user when manually feeding the disc tray in the recording apparatus. However, the technique disclosed in JP-A-2014-24233 is not easy to use for a recording apparatus including the medium support unit that is moved by driving of the motor.

Furthermore, in the recording apparatus disclosed in JP-A-2014-24233, the assist force is imparted if the disc tray comes into contact with the ejection driving roller, but the assist force is not imparted until the disc tray comes into contact with the ejection driving roller. Thus, even if the technique disclosed in JP-A-2014-24233 is used for the recording apparatus including the medium support unit that is moved by driving of the motor, there is a concern that the load of the user cannot be sufficiently suppressed.

SUMMARY

An advantage of some aspects of the invention is to suppress a load when moving a medium support unit, which is moved by driving of a motor, without depending on the driving of the motor.

According to a first aspect of the invention, there is provided a recording apparatus including a medium support unit that is capable of moving by driving of a motor in a moving direction and is capable of supporting a medium; a recording unit that records an image onto the medium supported on the medium support unit; and a control unit that allows the motor to execute an assist operation for assisting the movement of the medium support unit when recognizing the movement of the medium support unit without depending on the driving of the motor.

According to a second aspect of the invention, the recording apparatus may further include a scale unit that is capable of recognizing a position of the medium support unit, in which the control unit may allow the motor to execute the assist operation when recognizing a change in the position of the medium support unit without depending on the driving of the motor by the scale unit.

According to a third aspect of the invention, the recording apparatus may further include a first switch and a second switch, in which the control unit may allow the motor to execute a first assist operation in the assist operation generating an assist force from one side to the other side in the moving direction if the first switch is pressed, and the motor to execute a second assist operation in the assist operation generating the assist force from the other side to the one side if the second switch is pressed.

According to a fourth aspect, the recording apparatus may further include a pressure detecting unit that is capable of detecting a pressure applied to the medium support unit in the moving direction, in which the control unit may allow the motor to execute the assist operation based on the strength of the pressure detected by the pressure detecting unit.

According to the recording apparatus of a fifth aspect of the invention, the control unit may allow the motor to execute the assist operation such that the pressure detected by the pressure detecting unit is within a predetermined range.

According to the recording apparatus of a sixth aspect of the invention, the control unit may allow the motor to execute the assist operation such that the assist force is decreased when a moving speed of the medium support unit exceeds a predetermined speed during execution of the assist operation.

According to the recording apparatus of a seventh aspect of the invention, the control unit may allow the movement of the medium support unit to be switched to a non-assist state in which the movement is not assisted even when recognizing the movement of the medium support unit without depending on the driving of the motor.

According to the recording apparatus of an eighth aspect of the invention, a strength of the assist force in the assist operation may be configured so that the medium support unit is not propelled by the assist force's self.

According to a ninth aspect of the invention, there is provided a method for moving medium support unit in a recording apparatus of a ninth aspect of the invention including a medium support unit that is capable of moving by driving of a motor in a moving direction and is capable of supporting a medium and a recording unit that records an image onto the medium supported on the medium support unit, the method including allowing the motor to execute an assist operation for assisting a movement of the medium support unit and assisting the movement of the medium support unit when recognizing the movement of the medium support unit without depending on the driving of the motor.

In this case, it is possible to suppress the load when moving the medium support unit, which is moved by driving the motor, without depending on the driving of the motor.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1 (FIGS. 1 to 8)

Hereinafter, a recording apparatus 1 according to Example 1 of the invention will be described with reference to the accompanying drawings.

First, an outline of the recording apparatus 1 of the example will be described.

Figure 1:
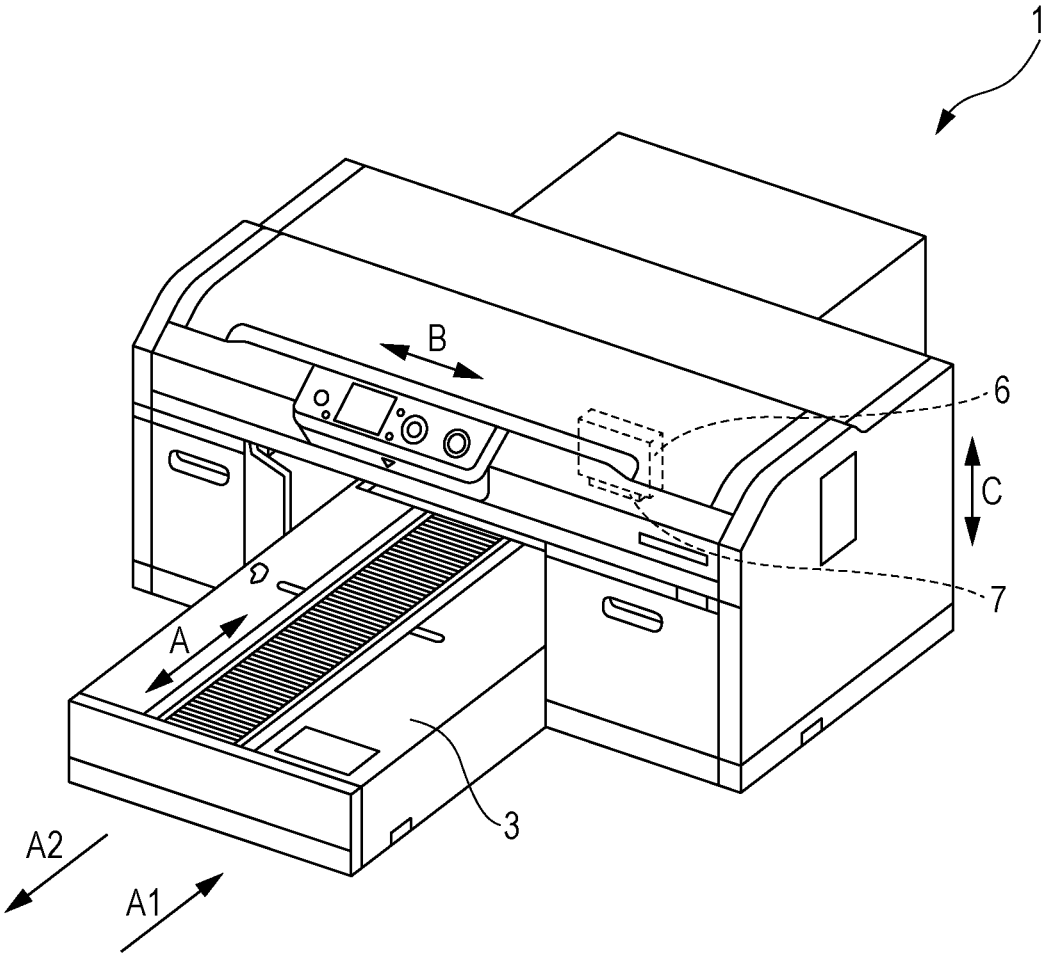
FIG. 1 is a schematic perspective view of a recording apparatus according to Example 1 of the invention.
Figure 2:
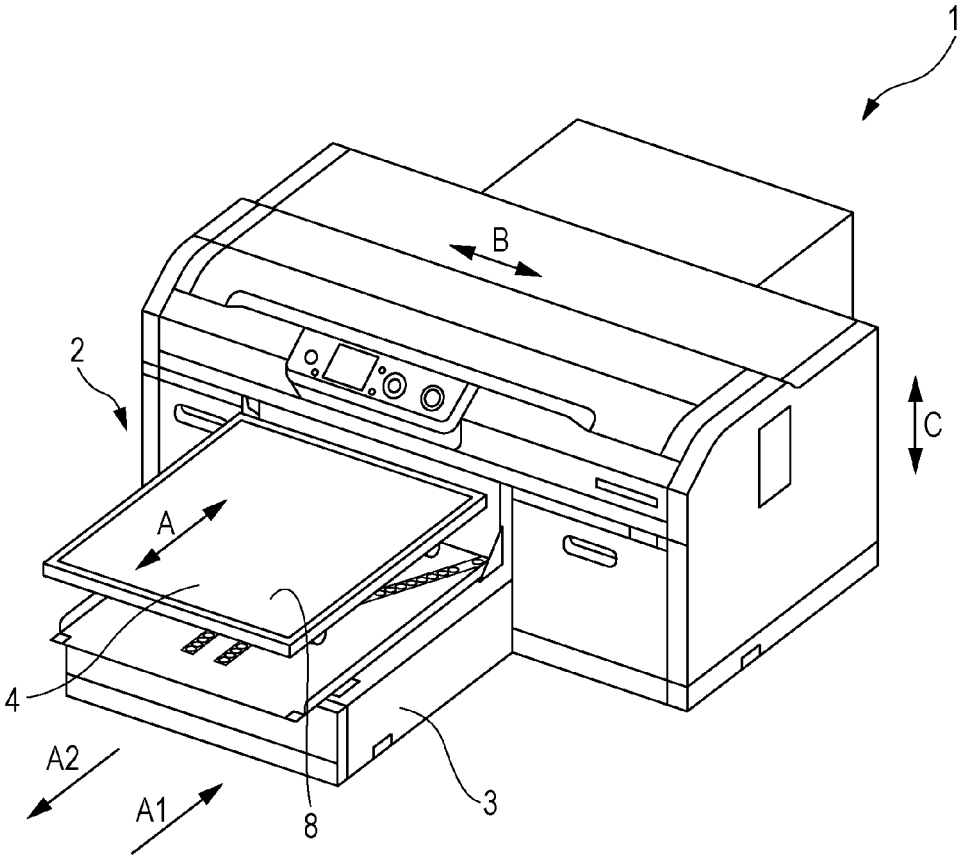
FIG. 2 is a schematic perspective view of the recording apparatus according to Example 1 of the invention.

FIGS. 1 and 2 are schematic perspective views of the recording apparatus 1 according to the example. FIG. 1 illustrates a state where a tray 4 as a support unit of the recording apparatus 1 of the example for supporting a medium M (see FIG. 6) is in a recording start position and FIG. 2 illustrates a state where the tray 4 is positioned in a set position of the medium M.

Figure 3:
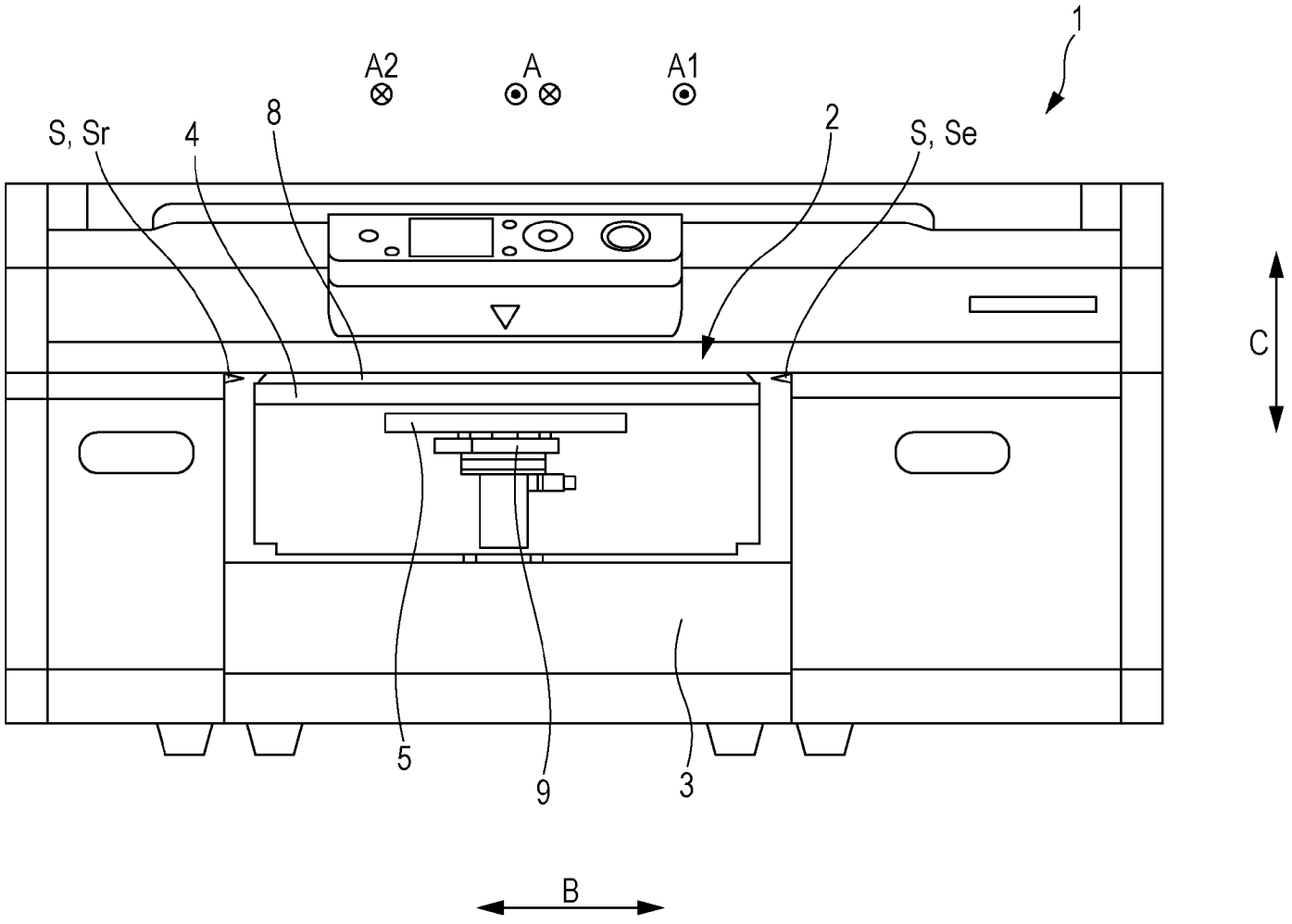
FIG. 3 is a schematic front view of the recording apparatus according to Example 1 of the invention.
Figure 4:
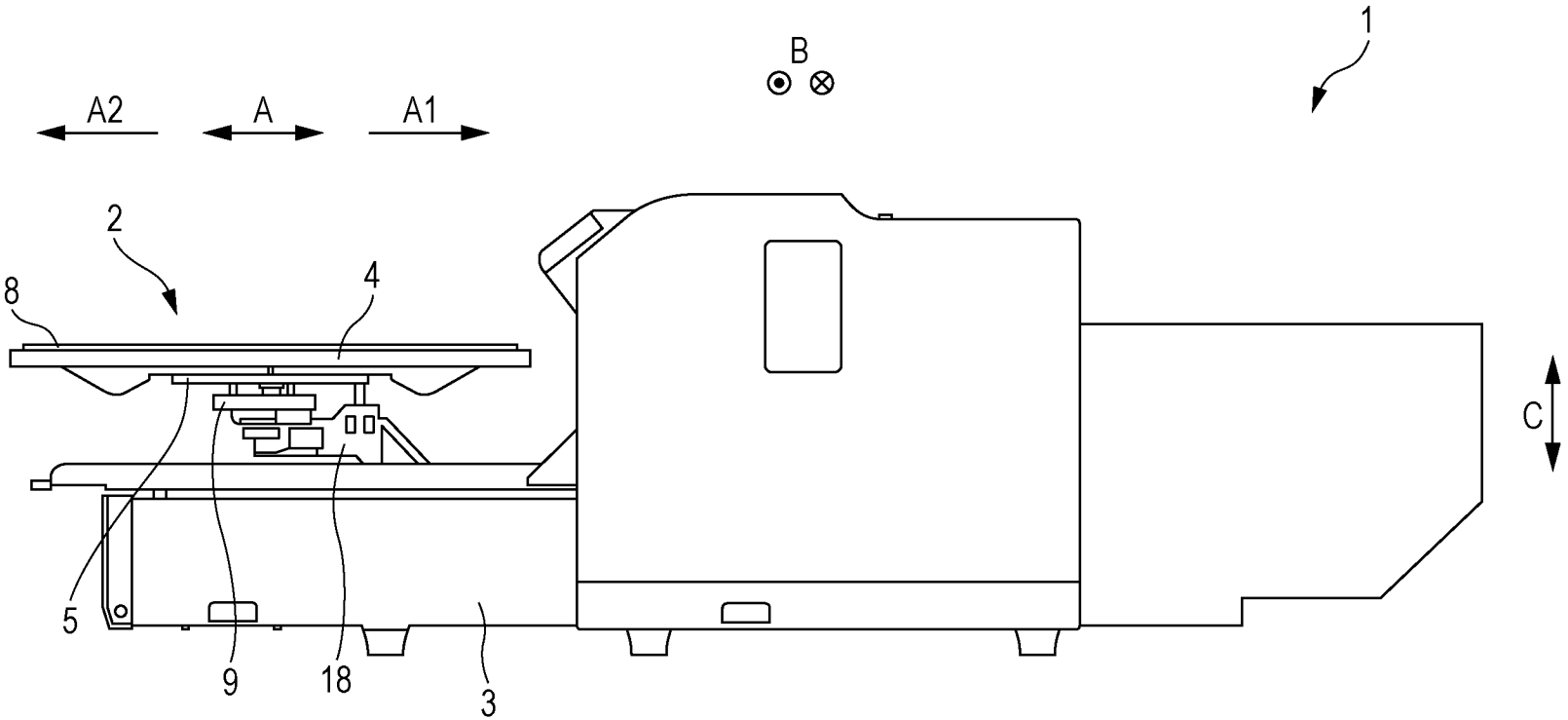
FIG. 4 is a schematic side view of the recording apparatus according to Example 1 of the invention.

Furthermore, FIG. 3 is a schematic front view of the recording apparatus 1 of the example and FIG. 4 is a schematic side view of the recording apparatus 1 of the example.

The recording apparatus 1 of the example includes a medium support unit 2 that is moved in a moving direction A in a state where the medium M is supported on a support surface 8 of the tray 4. The medium support unit 2 has the tray 4 that is the support unit of the medium M. The recording apparatus 1 includes a medium transport unit 3 that transports the medium M supported on the tray 4 in the moving direction A. The moving direction A is a direction including a direction A1 and a direction A2 that is opposite to the direction A1. Furthermore, the tray 4 is mounted on a stage 5. The tray 4 is moved in a height direction C together with the stage 5 by rotating a rotary lever 9. Moreover, as illustrated in FIG. 4, the rotary lever 9 is provided in an arm unit 18 of the medium support unit 2. Furthermore, as the medium M, it is possible to use various materials such as textile (woven, cloth, and the like), paper, and vinyl chloride resin.

Furthermore, a recording head 7 capable of performing recording onto the medium M by ejecting ink is provided on an inside of a body of the recording apparatus 1. In the example, the recording head 7 corresponds to a recording unit capable of executing recording onto the medium M. Then, the recording apparatus 1 of the example forms a desired image by ejecting the ink from the recording head 7 onto the medium M supported on the tray 4 while allowing the recording head 7 to reciprocate in an intersecting direction B by allowing a carriage 6 in which the recording head 7 is provided to reciprocate in the intersecting direction B intersecting the moving direction A.

Moreover, in the recording apparatus 1 of the example, a front side (lower left direction) in FIGS. 1 and 2 is a set position (corresponding to FIG. 2) of the medium M to the tray 4. Then, recording is performed while the tray 4 is moved in the direction A2 of the moving direction A after the tray 4 in which the medium M is set is moved in the direction A1 of the moving direction A to the recording start position (corresponding to FIG. 1) of a rear side (upper right direction) in FIGS. 1 and 2.

Moreover, the recording apparatus 1 of the example includes the recording head 7 that performs recording while reciprocating in the intersecting direction B and may be a recording apparatus including a so-called line head in which a plurality of nozzles ejecting the ink are provided in the intersecting direction B intersecting the moving direction A.

Here, the "line head" is a recording head that is used in a recording apparatus in which a region of the nozzles formed in the intersecting direction B intersecting the moving direction A of the medium M is provided so as to cover the entirety of the medium M in the intersecting direction B and the image is formed by relatively moving the recording head or the medium M. Moreover, the region of the nozzles of the line head in the intersecting direction B may not cover the entirety of all media M managed by the recording apparatus in the intersecting direction B.

Furthermore, the recording head 7 of the example is the recording unit capable of recording by ejecting the ink onto the medium M, but is not limited to the example, and, for example, a transfer type recording unit, which performs recording by transferring a color material to the medium M, may be used.

Furthermore, as illustrated in FIG. 3, the recording apparatus 1 of the example includes a sensor S and is configured to detect presence or absence of abnormality (distance between the medium M and the recording head 7 is too narrow) of a distance between the medium M supplied on the tray 4 and the recording head 7.

Here, the sensor S has a light emitting unit Se and a light receiving unit Sr. Then, the sensor S applies light from the light emitting unit Se to the light receiving unit Sr and is configured to detect presence or absence of the abnormality of the distance based on whether or not the light is received in the light receiving unit Sr. However, the sensor S is not limited to such a configuration.

Next, an electric configuration in the recording apparatus 1 of the example will be described.

Figure 5:
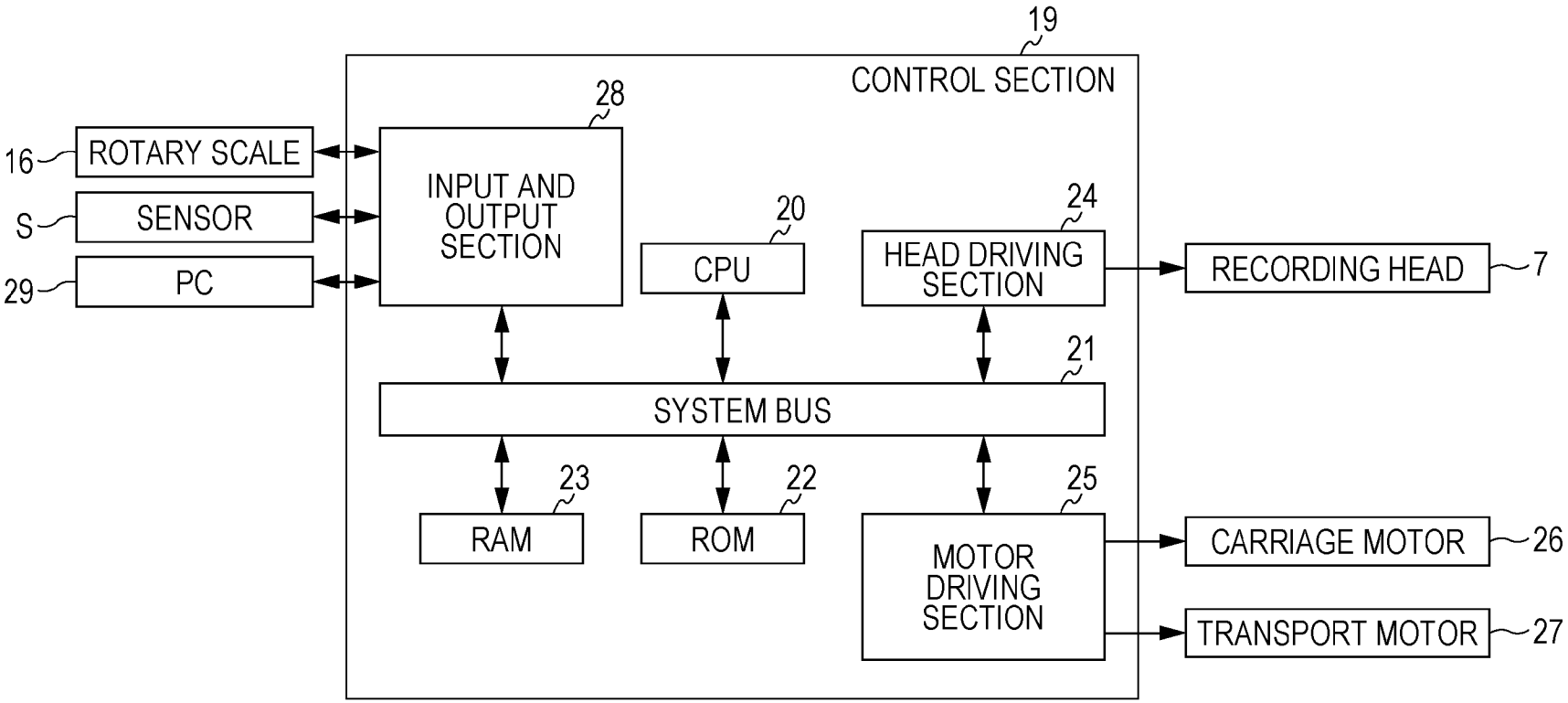
FIG. 5 is a block diagram of the recording apparatus according to Example 1 of the invention.

FIG. 5 is a block diagram of the recording apparatus 1 of the example.

A CPU 20 that performs control of the entirety of the recording apparatus 1 is provided in a control unit 19. The CPU 20 is connected to a ROM 22 storing various control programs executed by the CPU 20 and the like, and a RAM 23 capable of temporarily storing data through a system bus 21.

Furthermore, the CPU 20 is connected to a head driving unit 24 for driving the recording head 7 through the system bus 21.

Furthermore, the CPU 20 is connected to a motor driving unit 25 through the system bus 21. Then, the motor driving unit 25 is connected to a carriage motor 26 for moving the carriage 6 in which the recording head 7 is provided and a transport motor 27 provided in the medium transport unit 3 to transport (that is, move the medium support unit 2) the medium M.

Furthermore, the CPU 20 is connected to an input and output unit 28 through the system bus 21.

Then, the input and output unit 28 is connected to a rotary scale 16 as the scale unit capable of confirming a position of the medium support unit 2 in the moving direction A, the sensor S, and a PC 29 for performing transmitting and receiving of data such as recording data and a signal.

Next, the medium support unit 2 of the example and the medium transport unit 3 capable of transporting the medium M in the moving direction A by moving the medium support unit 2 in the moving direction A will be described in detail.

Figure 6:
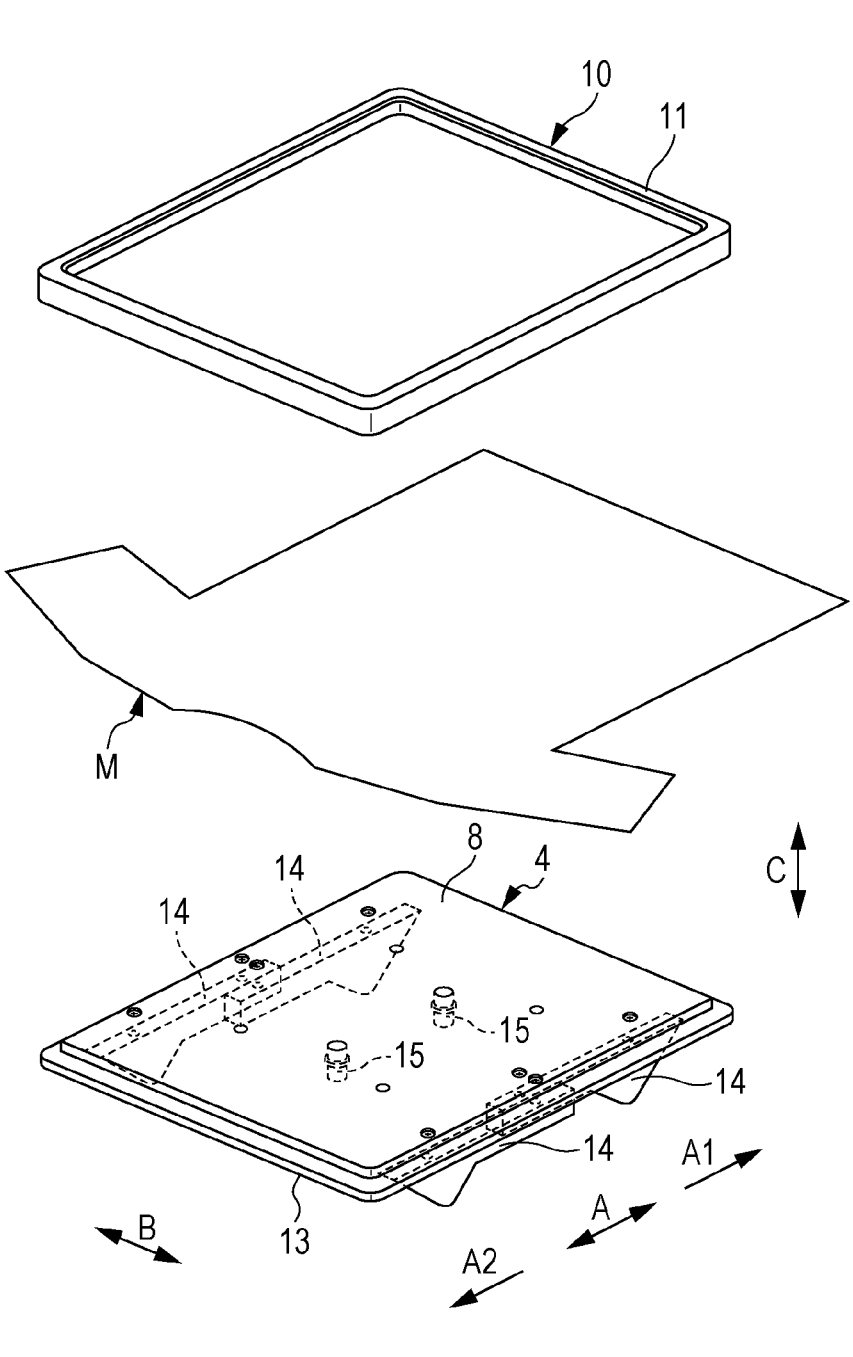
FIG. 6 is a schematic perspective view illustrating a part of a medium support unit of the recording apparatus according to Example 1 of the invention.

Here, FIG. 6 is a schematic perspective view illustrating a part of the medium support unit 2 of the example. Specifically, FIG. 6 is a schematic perspective view illustrating the tray 4 of the medium support unit 2 and a pressing unit 10.

As illustrated in FIG. 6, the medium support unit 2 of the example includes the tray 4 as the support unit capable of supporting the medium M and the frame-shaped pressing unit 10 capable of pressing the medium M supported on the tray 4.

Then, the medium M is supported on the support surface 8 of the tray 4, a canopy unit 11 of the pressing unit 10 is placed in an edge unit 13 of the tray 4, and thereby the medium M is able to be pressed by the pressing unit 10.

Moreover, the tray 4 of the example includes installation units 14 that are required when installing the tray 4 on a floor and the like by being removed from the stage 5, and positioning units 15 capable of positioning the tray 4 with respect to the stage 5.

However, configurations of the pressing unit 10 and the tray 4 are not specifically limited.

Figure 7:
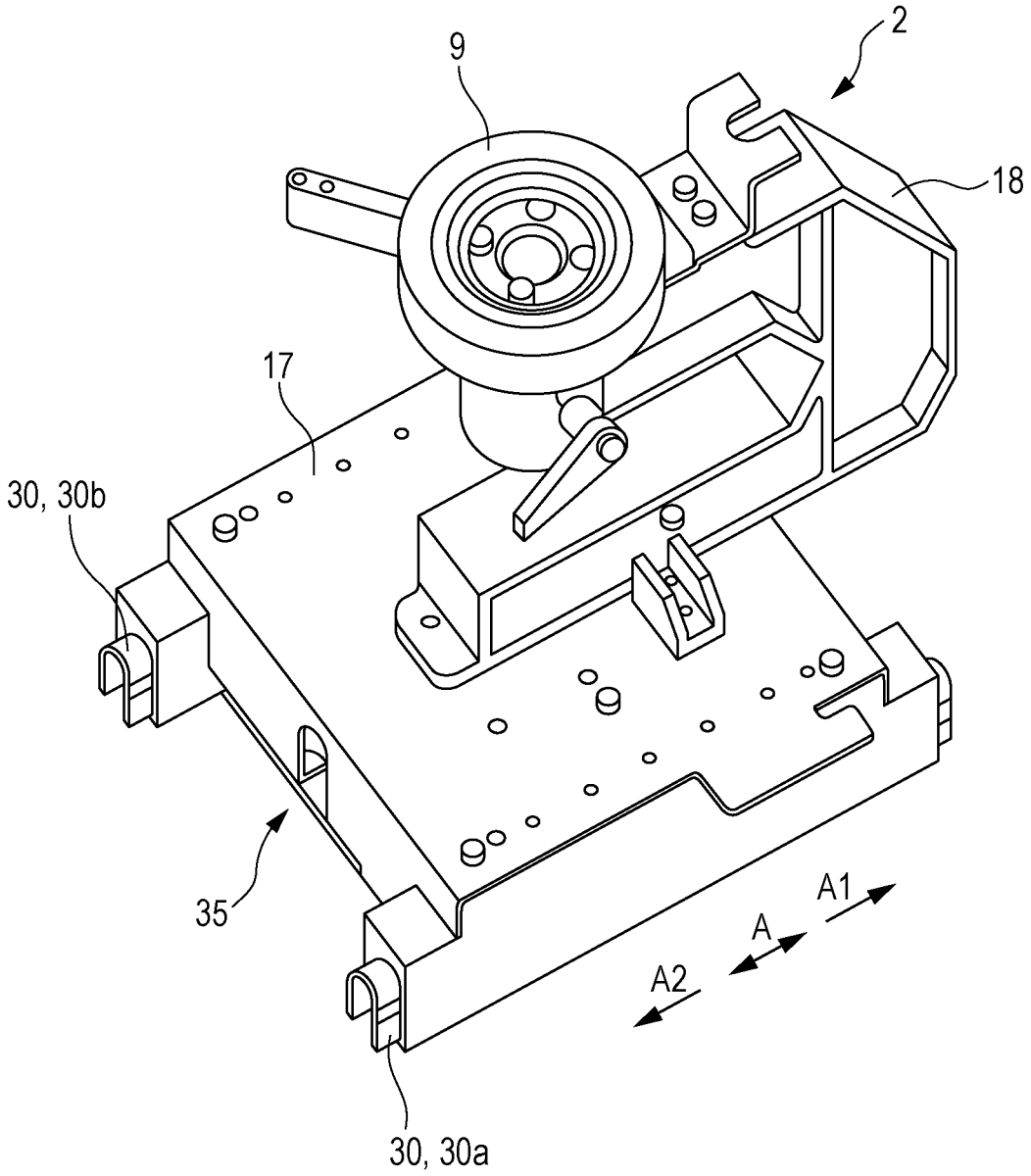
FIG. 7 is a schematic perspective view illustrating a part of the medium support unit of the recording apparatus according to Example 1 of the invention.

Furthermore, FIG. 7 is a schematic perspective view illustrating another part different from the portion illustrated in FIG. 6 in the medium support unit 2 of the example. Specifically, FIG. 7 is a schematic perspective view illustrating a state where the stage 5, the tray 4, and the pressing unit 10 are removed from the medium support unit 2.

Figure 8:
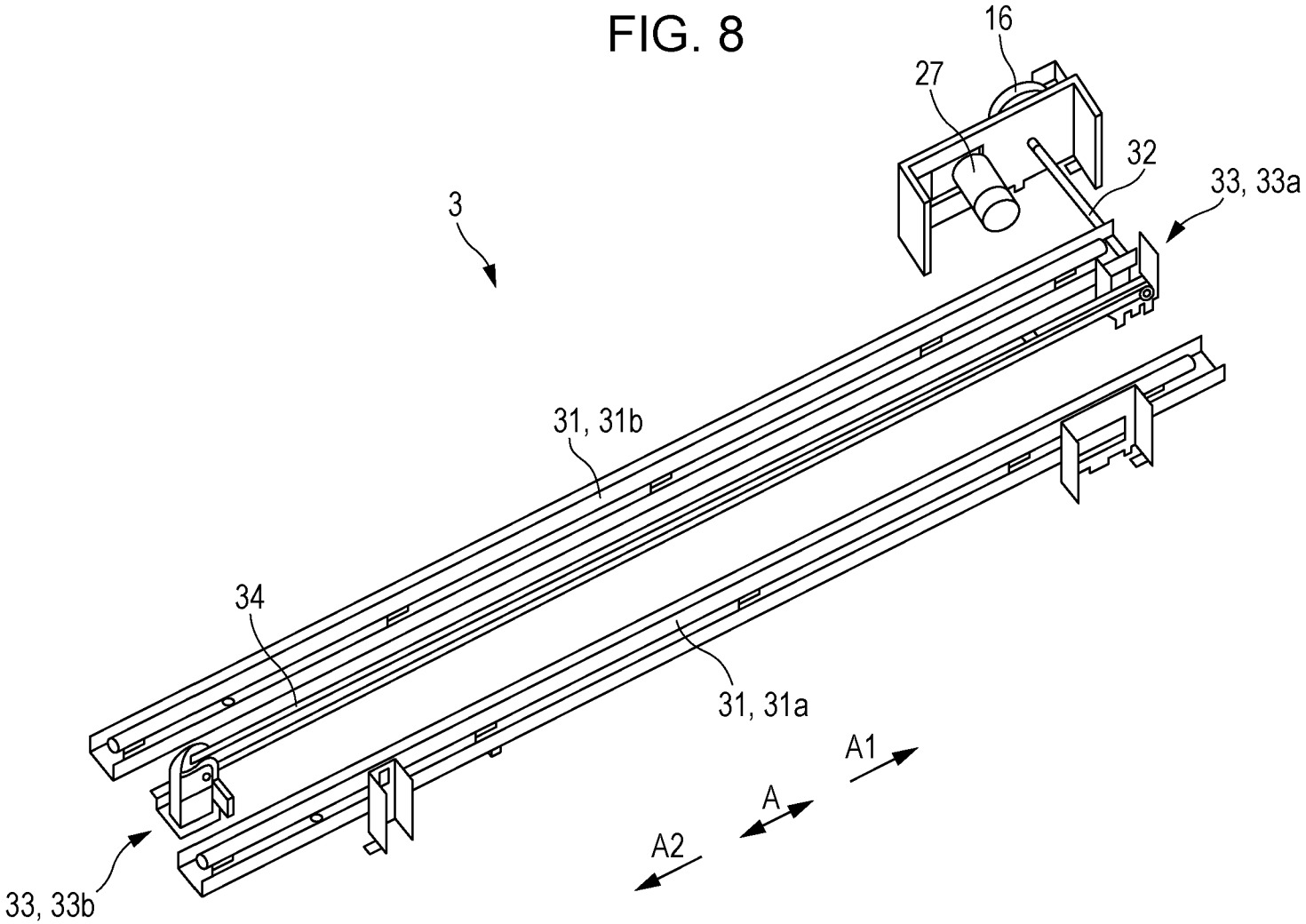
FIG. 8 is a schematic perspective view illustrating a part of a medium transport unit of the recording apparatus according to Example 1 of the invention.

Then, FIG. 8 is a schematic perspective view illustrating a part of the medium transport unit 3 of the example. Specifically, FIG. 8 is a schematic perspective view illustrating a moving mechanism of the medium support unit 2 on an inside of the medium transport unit 3.

As illustrated in FIG. 7, the medium support unit 2 of the example includes the arm unit 18 in which the rotary lever 9 is provided and a base unit 17 to which the arm unit 18 is fixed. Then, a bearing 30 and a belt retracting opening 35 are provided in the base unit 17.

On the other hand, as illustrated in FIG. 8, the medium transport unit 3 of the example is provided with two guide shafts 31 that extend in the moving direction A, a belt 34 that is bridged between belt bridge units 33, the transport motor 27, a rotation shaft 32 that is capable of transmitting a driving force of the transport motor 27 to the belt 34, and the rotary scale 16 that is capable of confirming a position of the medium support unit 2 in the moving direction A by measuring a rotational angle and the number of revolutions of the rotation shaft 32. Moreover, the driving force of the transport motor 27 is transmitted to a belt bridge unit 33*a* of the belt bridge units 33 formed of the belt bridge unit 33*a* and a belt bridge unit 33*b* through the rotation shaft 32, gears (not illustrated), and the like, and then is transmitted to the belt 34.

Here, a bearing 30*a* of the bearing 30 is mounted on a guide shaft 31*a* of the guide shafts 31 and a bearing 30*b* of the bearing 30 is mounted on a guide shaft 31*b* of the guide shafts 31.

Then, the belt 34 passes through the base unit 17 through the belt retracting opening 35 and a part of the belt 34 is fixed to a fixing unit (not illustrated) in the base unit 17.

The recording apparatus 1 of the example transmits the driving force of the transport motor 27 to the medium support unit 2 through the belt 34 and the like, and is able to move the medium support unit 2 in the moving direction A by such a configuration.

As described above, the recording apparatus 1 of the example includes the medium support unit 2 that is capable of moving in the moving direction A by driving the transport motor 27 and capable of supporting the medium M, and the recording head 7 that performs recording of the image onto the medium M supported on the medium support unit 2.

Then, the control unit 19 of the example can allow the transport motor 27 to execute an assist operation of assisting a movement of the medium support unit 2 when recognizing the movement of the medium support unit 2 without depending on the driving of the transport motor 27. Here, the movement of the medium support unit 2 without depending on the driving of the transport motor 27 refers that the medium support unit 2 is moved by applying a force from the outside. Specifically, a user and the like push or pull the medium support unit 2 and thereby such a movement can be provided. Thus, for example, when the user manually starts the movement of the medium support unit 2 without depending on the driving of the transport motor 27, it is possible to move the medium support unit 2 while suppressing a load by the assist operation.

Thus, the recording apparatus 1 of the example is configured to suppress the load when moving the medium support unit 2, which is moved by driving of the transport motor 27, without depending on the driving of the transport motor 27.

In other words, the control unit 19 recognizes the movement of the medium support unit 2 without depending on the driving of the transport motor 27 by using the recording apparatus 1 of the example and then the transport motor 27 executes the assist operation of assisting the movement. Thus, it is possible to execute a method of moving for the medium support unit 2 assisting the movement of the medium support unit 2. Then, it is possible to suppress the load when moving the medium support unit 2, which is moved by driving of the transport motor 27, without depending on the driving of the transport motor 27 by executing such a method of moving for the medium support unit 2.

Moreover, here, the "assist operation" means driving the transport motor 27 with assistance so that the medium support unit 2 is easily moved in the moving direction when moving the medium support unit 2 by the user without depending on the driving of the transport motor 27.

Furthermore, as described above, the recording apparatus 1 of the example includes the rotary scale 16 capable of recognizing the position of the medium support unit 2.

Then, the control unit 19 of the example can allow the transport motor 27 to execute the assist operation when confirming the position of the medium support unit 2 by the rotary scale 16 without depending on the driving of the transport motor 27. Thus, the recording apparatus 1 of the example is configured so as to execute the assist operation without imposing a load such as an operation of a switch and the like to the user.

Moreover, the recording apparatus 1 of the example includes the rotary scale 16 as the scale unit capable of confirming the position of the medium support unit 2, but is not specifically limited to the scale unit, and, for example, it is possible to use a linear scale instead of the rotary scale 16.

Furthermore, the recording apparatus 1 of the example includes a pressure sensor (not illustrated). The pressure sensor is configured to detect a pressure applied to the medium support unit 2 in the moving direction A. That is, the pressure sensor functions as a pressure detecting unit capable of detecting the pressure applied to the medium support unit 2.

Then, the control unit 19 can allow the transport motor 27 to execute the assist operation based on the strength of the detected pressure. Thus, the recording apparatus 1 of the example is configured to execute an appropriate assist operation according to the pressure applied to the medium support unit 2 in the moving direction A, for example, when moving the medium support unit 2 that is manually performed by an operation of the user.

More particularly, the control unit 19 of the example can allow the transport motor 27 to execute the assist operation such that the detected pressure is within a predetermined range. For example, if the user applies a force to the medium support unit 2 with a strong force, a large assist force is applied to the medium support unit 2 and if the user applies a force to the medium support unit 2 with a weak force, a small assist force is applied to the medium support unit 2. Thus, it is possible to execute the assist operation such that the pressure applied to the medium support unit 2 in the moving direction A does not greatly vary. Thus, the recording apparatus 1 of the example is configured such that it is possible to suppress that ease of the movement of the medium support unit 2 varies by greatly varying the pressure applied to the medium support unit 2 in the moving direction A, for example, when moving the medium support unit 2 that is manually performed by the operation of the user. In other words, for example, when movement of the medium support unit 2 is manually performed by the operation of the user, even if the user applies the force to the medium support unit 2 with a strong force, or even if the user applies the force to the medium support unit 2 with a weak force, it is possible to prevent the force from being applied too heavily or too lightly.

Furthermore, the control unit 19 of the example is capable of recognizing a moving speed of the medium support unit 2 during execution of the assist operation by reading the rotary scale 16 and if the moving speed exceeds a predetermined speed, can allow the transport motor 27 to execute the assist operation so as to reduce the assist force.

If the moving speed of the medium support unit 2 is too fast during the assist operation, there is a possibility of the occurrence of a malfunction that the medium support unit 2 is unlikely to stop at a desired position or there is a possibility of the occurrence of a malfunction that the user comes into contact with the medium support unit 2.

The control unit 19 of the example allows the transport motor 27 to perform the assist operation so as to reduce the assist force if the moving speed of the medium support unit 2 exceeds a predetermined speed during execution of the assist operation. Thus, the recording apparatus 1 of the example can suppress the occurrence of a malfunction that the moving speed of the medium support unit 2 is too fast during the assist operation.

Furthermore, the control unit 19 of the example can switch the movement of the medium support unit 2 to the non-assist state in which the movement of the medium support unit 2 is not assisted even if the movement of the medium support unit 2 without depending on the driving of the transport motor 27 is recognized. For example, if the assist operation is executed during (during recording) executing recording on the medium M, the quality of the image recorded onto the medium M may be lowered. Thus, the recording apparatus 1 of the example is configured such that the assist operation cannot be executed if the medium support unit 2 is not desired to be moved during recording and the like, or if the medium support unit 2 is not required to be moved.

Moreover, the recording apparatus 1 of the example is configured such that the control unit 19 recognizes the state of the recording apparatus 1 and thereby the recording apparatus 1 can be switched to the non-assist state according to the state, but, for example, the recording apparatus 1 may be configured to be switched to the non-assist state by a switch.

Here, in the recording apparatus 1 of the example, a strength of the assist force in the assist operation is configured so that the medium support unit 2 is not propelled by the assist force's self. Specifically, the control unit 19 controls the driving of the transport motor 27 such that the strength of the assist force in the assist operation is configured so that the medium support unit 2 is not propelled by the assist force's self. Thus, the movement of the medium support unit 2 is suppressed so as not to be the demand or more of the user by self-propelling of the medium support unit 2 during the assist operation.

Furthermore, the control unit 19 of the example can also change the strength of the assist force in the assist operation according to the position of the medium support unit 2 that is confirmed by the rotary scale 16. When the position of the medium support unit 2 is close to the user, the user can easily apply the force for moving the medium support unit 2, but when the position of the medium support unit 2 is far from the user, it is difficult for the user to apply the force for moving the medium support unit 2. Thus, for example, when the position of the medium support unit 2 is in a position of a leading side in the direction A2 (corresponding to when the position of the medium support unit 2 is close to the user), the assist force is reduced in the assist operation, and when the position of the medium support unit 2 is in a position on a leading side in the direction A1 (corresponding to when the position of the medium support unit 2 is away from the user), the assist force can be increased in the assist operation.

Figure 9:
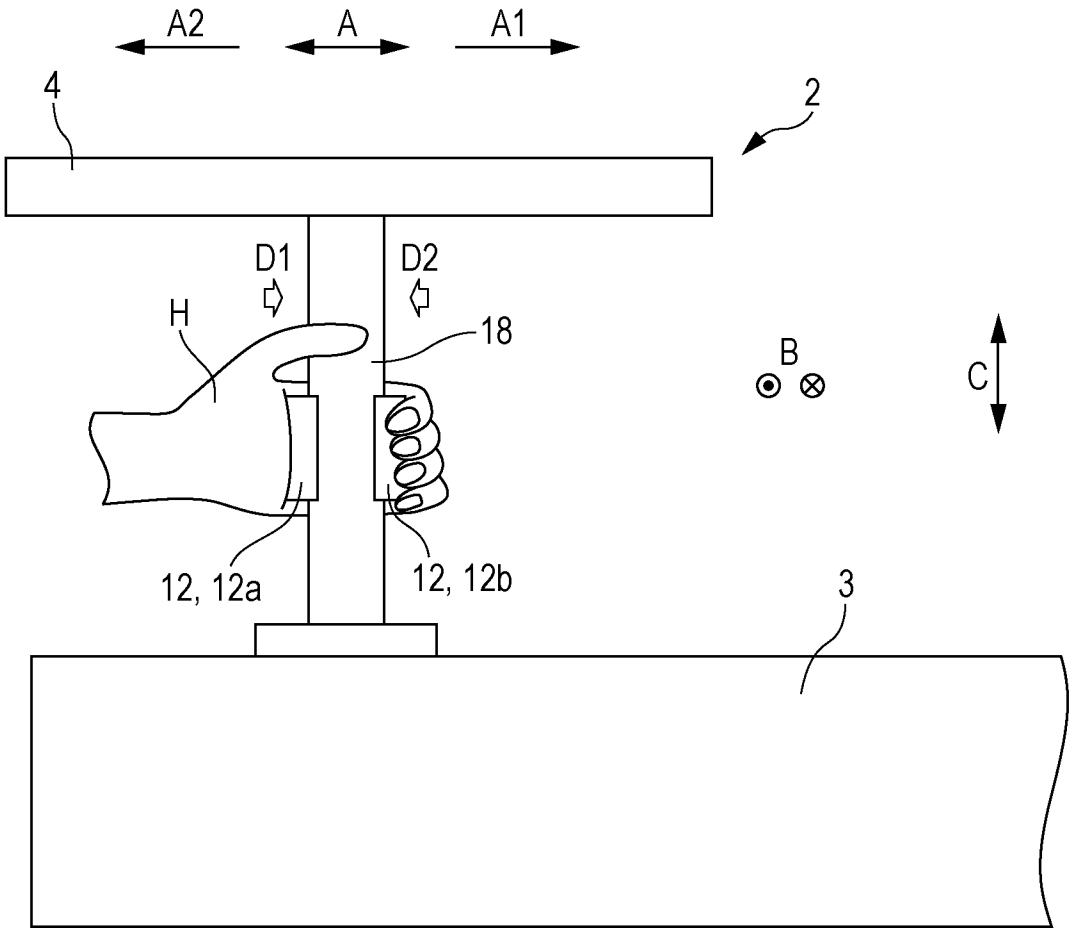
FIG. 9 is a schematic side view of a main portion of a recording apparatus according to Example 2 of the invention.

Example 2 (FIG. 9)

Next, a recording apparatus 1 according to Example 2 of the invention will be described.

FIG. 9 is a schematic side view illustrating a periphery of a medium support unit 2 that is a main portion of the recording apparatus 1 of the example. Moreover, the same reference numerals are given to the configuration members common with the Example 1 described above and detailed description will be omitted.

The recording apparatus 1 of the Example 1 includes the rotary scale 16 capable of confirming the position of the medium support unit 2 and is configured such that the control unit 19 allows the transport motor 27 to execute the assist operation if the change in the position of the medium support unit 2 without depending on the driving of the transport motor 27 by the rotary scale 16.

On the other hand, the recording apparatus 1 of the example is configured to include switches 12 executing an assist operation instead of the rotary scale 16.

As illustrated in FIG. 9, the recording apparatus 1 of the example includes a first switch 12*a* and a second switch 12*b* as the switches 12.

Then, a control unit 19 of the example allows a transport motor 27 to perform a first assist operation in an assist operation generating an assist force in a direction A1 from one side to the other side of a moving direction A if the first switch 12*a* is pressed in a direction D1. Then, the control unit 19 allows the transport motor 27 to perform a second assist operation in the assist operation generating the assist force in a direction A2 from the other side to the one side of the moving direction A if the second switch 12*b* is pressed in a direction D2. Moreover, the first switch 12*a* and the second switch 12*b* are configured to stop the generation of the assist force in a state of being not pressed.

As described above, the recording apparatus 1 of the example is configured such that the switches 12 are pressed by applying a force to the medium support unit 2 in a direction (moving direction of the medium support unit 2 without depending on the driving of the transport motor 27) in which a user manually moves the switches 12. For example, if the medium support unit 2 is wanted to be moved in the direction A1, an arm unit 18 in which the switches 12 are provided is pressed by the hand H of the user in the direction D1 that is a direction along the direction A1 and thereby the first switch 12*a* is pressed. Then, similarly, if the medium support unit 2 is wanted to be moved in the direction A2, the arm unit 18 in which the switches 12 are provided is pulled by the hand H of the user in the direction D2 that is a direction along the direction A2 and thereby the second switch 12*b* is pressed. Thus, the recording apparatus 1 of the example is configured such that the assist operation can be appropriately executed by the configuration to press the switches 12 in the direction corresponding to a direction in which the user wants to move the medium support unit 2.

However, the invention is not limited to the configuration in which the switches 12 are disposed in such positions. For example, the switches 12 may be provided in a tray 4 or may be provided in a housing of the recording apparatus 1 and the like.

Moreover, the invention is not limited to the examples described above, is capable of various modifications within the scope of the invention described in the claims, and it goes without saying that the modifications are also included within the scope of the invention.

As described above, the invention is described in detail based on the specific examples. Here, the invention will be described together gain.

According to a first aspect of the invention, the recording apparatus 1 includes the medium support unit 2 that is capable of moving by driving of the motor 27 in the moving direction and is capable of supporting the medium M, the recording unit 7 that records the image onto the medium M supported on the medium support unit 2, and the control unit 19 that allows the motor 27 to execute the assist operation for assisting the movement of the medium support unit 2 when recognizing the movement of the medium support unit 2 without depending on the driving of the motor 27.

According to the aspect, when recognizing the movement of the medium support unit 2 without depending on the driving of the transport motor 27, the motor 27 executes the assist operation for assisting the movement of the medium support unit 2. Thus, for example, when the user manually starts the movement of the medium support unit 2 without depending on the driving of the transport motor 27, it is possible to move the medium support unit 2 while suppressing the load.

Thus, it is possible to suppress the load when moving the medium support unit 2, which is moved by driving of the transport motor 27, without depending on the driving of the transport motor 27.

According to a second aspect of the invention, in the first aspect, the recording apparatus 1 includes the scale unit 16 that is capable of recognizing the position of the medium support unit 2 and the control unit 19 allows the motor 27 to execute the assist operation when recognizing the change in the position of the medium support unit 2 without depending on the driving of the motor 27 by the scale unit 16.

According to the aspect, the control unit 19 of the example allows the transport motor 27 to execute the assist operation when confirming the change in the position of the medium support unit 2 by the rotary scale 16 without depending on the driving of the transport motor 27. Thus, it is possible to execute the assist operation without imposing the load such as the operation of the switch and the like to the user.

According to a third aspect of the invention, in the first aspect, the recording apparatus 1 includes the first switch 12*a* and the second switch 12*b*, and the control unit 19 allows the motor 27 to execute the first assist operation in the assist operation generating the assist force from one side to the other side in the moving direction A if the first switch 12*a* is pressed, and the motor 27 to execute the second assist operation in the assist operation generating the assist force from the other side to the one side if the second switch 12*b* is pressed.

According to the aspect, the control unit 19 allows the motor 27 to perform the first assist operation generating the assist force from one side to the other side if the first switch 12*a* is pressed and allows the motor 27 to perform the second assist operation generating the assist force from the other side to the one side if the second switch 12*b* is pressed. Thus, it is possible to appropriately perform the assist operation by the configuration in which the switch is pressed in the direction corresponding to the direction in which the user wants to move the medium support unit 2.

According to a fourth aspect of the invention, in any one of the first to third aspects, the recording apparatus 1 includes the pressure detecting unit that is capable of detecting the pressure applied to the medium support unit 2 in the moving direction A, and the control unit 19 allows the motor 27 to execute the assist operation based on the strength of the pressure detected by the pressure detecting unit.

According to the aspect, the control unit 19 allows the motor 27 to execute the assist operation based on the strength of the pressure detected by the pressure detecting unit. Thus, it is possible to execute the appropriate assist operation according to the pressure applied to the medium support unit 2 in the moving direction A, for example, when moving the medium support unit 2 that is manually performed by the operation of the user.

In the recording apparatus 1 of a fifth aspect of the invention according to the fourth aspect, the control unit 19 allows the motor 27 to execute the assist operation such that the pressure detected by the pressure detecting unit is within a predetermined range.

According to the aspect, the control unit 19 allows the motor 27 to execute the assist operation such that the pressure detected by the pressure detecting unit is within the predetermined range. Thus, it is possible to execute the assist operation such that the pressure applied to the medium support unit 2 in the moving direction A does not greatly vary. Thus, it is possible to suppress that ease of the movement of the medium support unit 2 varies by greatly varying the pressure applied to the medium support unit 2 in the moving direction A, for example, when moving the medium support unit 2 that is manually performed by the operation of the user.

In the recording apparatus 1 of a sixth aspect of the invention according to any one of the first to fifth aspects, the control unit 19 allows the motor 27 to execute the assist operation such that the assist force is decreased when the moving speed of the medium support unit 2 exceeds the predetermined speed during execution of the assist operation.

According to the aspect, the control unit 19 allows the motor 27 to execute the assist operation such that the assist force is decreased when the moving speed of the medium support unit 2 exceeds the predetermined speed during execution of the assist operation. Thus, it is possible to suppress occurrence of malfunction that the moving speed of the medium support unit 2 is too fast during the assist operation.

In the recording apparatus 1 of a seventh aspect of the invention according to the first to sixth aspects, the control unit 19 allows the movement of the medium support unit 2 to be switched to the non-assist state in which the movement is not assisted even when recognizing the movement of the medium support unit 2 without depending on the driving of the motor 27.

According to the aspect, the control unit 19 allows the movement of the medium support unit 2 to be switched to the non-assist state in which the movement is not assisted even when recognizing the movement of the medium support unit 2 without depending on the driving of the motor 27. Thus, it is possible to make the assist operation cannot be executed if the medium support unit 2 is not wanted to be moved, or if the medium support unit 2 is not required to be moved.

In the recording apparatus of the eighth aspect of the invention according to any one of the first to seventh aspects, the strength of the assist force in the assist operation is configured so that the medium support unit 2 is not propelled by the assist force's self.

According to the aspect, the strength of the assist force in the assist operation is configured so that the medium support unit 2 is not propelled by the assist force's self. Thus, the movement of the medium support unit 2 can be suppressed not to be the demand or more of the user by self-propelling of the medium support unit 2 during the assist operation.

According to a ninth aspect of the invention, the method for moving the medium support unit 2 of the recording apparatus 1 including the medium support unit 2 that is capable of moving by driving of the motor 27 in the moving direction A and is capable of supporting the medium M and the recording unit 7 that records the image onto the medium M supported on the medium support unit 2, the method includes allowing the motor 27 to execute the assist operation for assisting the movement of the medium support unit 2 and assisting the movement of the medium support unit 2 when recognizing the movement of the medium support unit 2 without depending on the driving of the motor 27.

According to the aspect, the motor 27 is allowed to execute the assist operation for assisting the movement of the medium support unit 2 and the movement of the medium support unit 2 is assisted when recognizing the movement of the medium support unit 2 without depending on the driving of the motor 27. Thus, for example, when the user manually starts the movement of the medium support unit 2 without depending on the driving of the motor, it is possible to move the medium support unit 2 while suppressing the load. Thus, it is possible to suppress the load when moving the medium support unit 2, which is moved by driving of the motor 27, without depending on the driving of the motor 27.

The entire disclosure of Japanese Patent Application No. 2015-057889, filed Mar. 20, 2015 is expressly incorporated reference herein.

What is claimed is:

1. A recording apparatus comprising:

a medium support unit that is capable of moving by driving of a motor in a moving direction and is capable of supporting a medium;

a recording unit that records an image onto the medium supported on the medium support unit; and a control unit that allows the motor to execute an assist operation for assisting the movement of the medium support unit when recognizing the movement of the medium support unit without depending on the driving of the motor, wherein during the assist operation the motor is driven by a force provided by a user of the recording apparatus such that a load of the motor that prevents the movement of the medium support unit is suppressed so that the movement occurs without the need to internally drive the motor.

2. The recording apparatus according to claim 1, further comprising:

a scale unit that is capable of confirming a position of the medium support unit, wherein the control unit allows the motor to execute the assist operation when confirming a change in the position of the medium support unit without depending on the driving of the motor by the scale unit.

3. The recording apparatus according to claim 1, further comprising:

a first switch and a second switch, wherein the control unit allows the motor to execute a first assist operation in the assist operation generating an assist force from one side to the other side in the moving direction if the first switch is pressed, and the motor to execute a second assist operation in the assist operation generating the assist force from the other side to the one side if the second switch is pressed.

4. The recording apparatus according to claim 1, further comprising:

a pressure detecting unit that is capable of detecting a pressure applied to the medium support unit in the moving direction, wherein the control unit allows the motor to execute the assist operation based on a strength of the pressure detected by the pressure detecting unit.

5. The recording apparatus according to claim 4, wherein the control unit allows the motor to execute the assist operation such that the pressure detected by the pressure detecting unit is within a predetermined range.

6. The recording apparatus according to claim 1, wherein the control unit allows the motor to execute the assist operation such that the assist force is decreased when a moving speed of the medium support unit exceeds a predetermined speed during execution of the assist operation.

7. The recording apparatus according to claim 1, wherein the control unit allows the movement of the medium support unit to be switched to an non-assist state in which the movement is not assisted even when recognizing the movement of the medium support unit without depending on the driving of the motor.

8. The recording apparatus according to claim 1, wherein a strength of the assist force in the assist operation is configured so that the medium support unit is not propelled by the assist force's self.

9. A method for moving medium support unit in a recording apparatus including a medium support unit that is capable of moving by driving of a motor in a moving direction and is capable of supporting a medium and a recording unit that records an image onto the medium supported on the medium support unit, the method comprising:

allowing the motor to execute an assist operation for assisting a movement of the medium support unit and assisting the movement of the medium support unit when recognizing the movement of the medium support unit without depending on the driving of the motor, wherein during the assist operation the motor is driven by a force provided by a user of the recording apparatus such that a load of the motor that prevents the movement of the medium support unit is suppressed so that the movement occurs without the need to internally drive the motor.

* * * * *